US008845069B2

(12) United States Patent
Koehler et al.

(10) Patent No.: US 8,845,069 B2
(45) Date of Patent: Sep. 30, 2014

(54) CONTROL SIGNALING USING CAPACITIVE HUMIDITY SENSOR

(71) Applicant: Hewlett-Packard Development Company, L.P., Houston, TX (US)

(72) Inventors: Duane Koehler, Vancouver, WA (US); Algird M. Gudaitis, Vancouver, WA (US); Mark Westlund, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/751,328

(22) Filed: Jan. 28, 2013

(65) Prior Publication Data

US 2014/0210897 A1 Jul. 31, 2014

(51) Int. Cl.
*B41J 29/38* (2006.01)
*B41J 29/393* (2006.01)
*B41J 2/01* (2006.01)

(52) U.S. Cl.
CPC ..... *B41J 2/01* (2013.01)
USPC ..... 347/19; 347/14

(58) Field of Classification Search
USPC ..... 347/5, 7, 14, 17, 19, 23
See application file for complete search history.

(56) References Cited

U.S. PATENT DOCUMENTS

| | | | | |
|---|---|---|---|---|
| 4,933,684 | A * | 6/1990 | Tasaki et al. | 347/17 |
| 5,757,195 | A * | 5/1998 | Bird | 324/678 |
| 6,109,723 | A | 8/2000 | Castle et al. | |
| 6,149,327 | A | 11/2000 | Ward et al. | |
| 6,315,379 | B1 * | 11/2001 | Adams et al. | 347/14 |
| 6,382,762 | B1 | 5/2002 | Therien | |
| 6,457,801 | B1 | 10/2002 | Fish et al. | |
| 6,568,780 | B2 | 5/2003 | Gudaitis et al. | |
| 2001/0007458 | A1 * | 7/2001 | Purcell et al. | 347/19 |
| 2012/0007908 | A1 | 1/2012 | Masuda | |

OTHER PUBLICATIONS

Martin, et al. Design for Variety: A Methodology for Developing Product Platform Architectures. Proceedings of DETC2000. 2000 ASME Design Engineering Technical Conferences.

* cited by examiner

*Primary Examiner* — Hai C Pham

(57) ABSTRACT

A circuit includes a capacitive-type humidity sensor. The circuit provides start and stop signals to a processor in accordance with a charge voltage across the sensor. The processor performs a counting function to derive an integer count value in response to the start and stop signals. The processor uses the integer count value to determine parameters for controlling an ink-jetting print engine. Printing speed can be controlled in accordance with ambient humidity and/or temperature so that the printed media are sufficiently dried before handling by a user or other operations.

13 Claims, 4 Drawing Sheets

400

| | DRYING TIME | RELATIVE HUMIDITY | INTEGER COUNT |
|---|---|---|---|
| 402 | LONG | 73% - 80% | GREATER THAN 519 |
| 404 | MODERATE | 62% - 72% | 512 - 519 |
| 406 | SHORT | 20% - 61% | LESS THAN 512 |

500

| ELEMENT | PART OR VALUE | SOURCE OR VENDOR |
|---|---|---|
| 202 | LM393 COMPARATOR (1 of 2) | TEXAS INSTRUMENTS |
| 212 | 10K OHM RESISTOR | -VARIOUS- |
| 214 | LM393 COMPARATOR (2 of 2) | TEXAS INSTRUMENTS |
| 218 | 10K OHM RESISTOR | -VARIOUS- |
| 220 | HS1101LF HUMIDITY SENSOR | MEASUREMENT SPEC. INC. |
| 224 | 50K OHM RESISTOR (or EQUIV) | -VARIOUS- |
| 226 | 976.0 OHM RESISTOR | -VARIOUS- |
| 228 | 1.91K OHM RESISTOR | -VARIOUS- |
| 230 | 374.0 OHM RESISTOR | -VARIOUS- |
| 238 | 0.1 MICROFARAD CAPACITOR | -VARIOUS- |
| 240 | 47K OHM RESISTOR | -VARIOUS- |
| 242 | 475K OHM RESISTOR | -VARIOUS- |
| 244 | 47K OHM RESISTOR | -VARIOUS- |
| 246 | 220K OHM RESISTOR | -VARIOUS- |
| 248 | 0.1 MICROFARAD CAPACITOR | -VARIOUS- |

FIG. 5

CONTROL SIGNALING USING CAPACITIVE HUMIDITY SENSOR

BACKGROUND

Ink-jetting printers form images on media using one or more colors of liquid ink. Printed images free from smudging, smearing or other artifacts are desirable. Ambient conditions such as humidity or temperature can be factors with respect to sufficient media drying time, so that smudging or other artifacts are reduced or eliminated during ink-jet printing.

BRIEF DESCRIPTION OF THE DRAWINGS

The present embodiments will now be described, by way of example, with reference to the accompanying drawings, in which:

FIG. 5 depicts a table of electronic circuit constituents in accordance with an example of the present teachings.

DETAILED DESCRIPTION

Introduction

Systems and methods for controlling a printer in accordance with a humidity measurement are provided. A circuit includes a capacitive-type humidity sensor. The circuit provides start and stop signals to a processor in accordance with a charge voltage across the sensor. The processor performs a counting function to derive an integer count value in response to the start and stop signals. The processor uses the integer count value to determine parameters for controlling an ink-jetting print engine. Printing speed can be controlled in accordance with ambient humidity and/or temperature so that the printed media are sufficiently dried before handling by a user or other operations.

In one example, an electronic circuit includes a sensor characterized by an electrical capacitance varying in accordance with ambient humidity. The sensor provides a charge voltage signal. The electronic circuit also includes a first comparator to assert a start signal in accordance with a comparison of the charge voltage signal with a first threshold voltage. The electronic circuit also includes a second comparator to assert a stop signal in accordance with a comparison of the charge voltage signal with a second threshold voltage.

In another example, a printing system includes a print engine to form images on media by way of ink-jetting. The printing system also includes a processor to control operation of the print engine, and a sensing circuit including a sensor characterized by an electrical capacitance varying according to ambient humidity. The sensing circuit provides a start signal and a stop signal to the processor. The printing system further includes a storage media including a machine-readable program code. The program code is configured to cause the processor to derive an integer count value in accordance with the start signal and the stop signal. The program code is also configured to cause the processor to determine at least one parameter for controlling the print engine using the integer count value.

Illustrative Ink-Jetting Printing System

Figure 1:
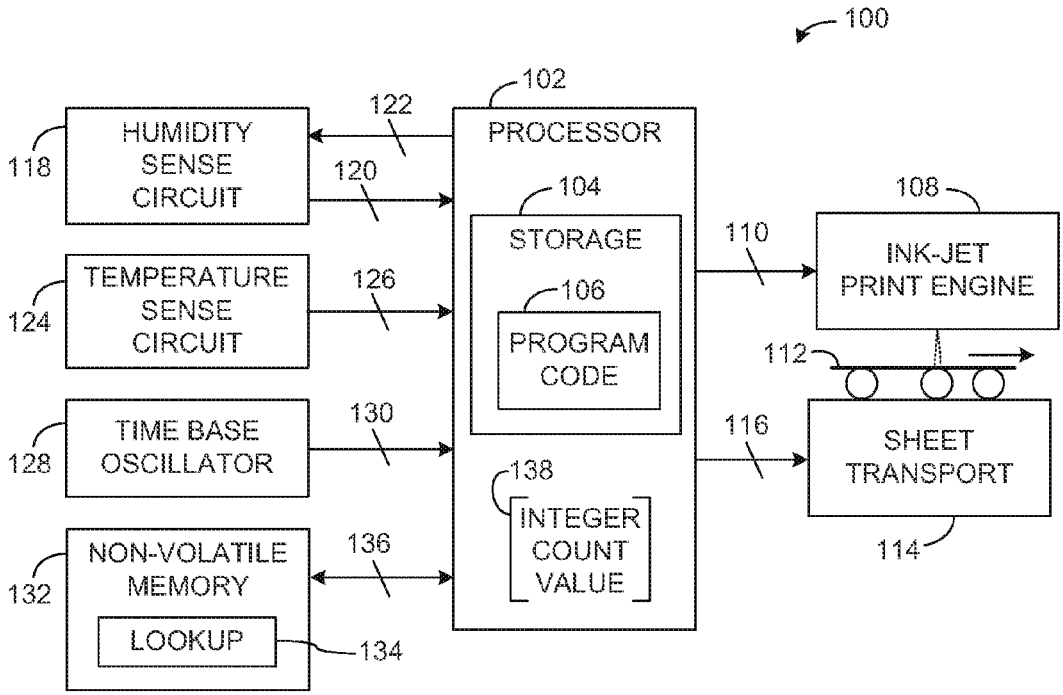
FIG. 1 depicts block diagram of an ink-jetting printing system according to one example of the present teachings.

Attention is directed now to FIG. 1, which depicts a block diagram of an ink-jetting printing system (system) 100 in accordance with the present teachings. The system 100 is illustrative and non-limiting with respect to the present teachings. Other systems, devices, constituencies or configurations can also be used.

The system 100 includes a processor 102. The processor 102 can be defined by a microprocessor, microcontroller or the like configured to perform various normal operations in accordance with a machine-readable program code. The processor 100 also includes a non-volatile storage 104, having a machine-readable program code 106 stored and accessible there within.

The system 100 also includes an ink-jetting print engine 108. The print engine 108 is coupled to and controlled by the processor 102 in accordance with control signals 110. The print engine 108 is configured to form images (i.e., text, photos, indicia, and the like) on sheet media 112. In one example, such sheet media 112 are respective sheets of paper that are transported past the print engine 108 by way of a transport mechanism 114 in accordance with control signaling 116 from the processor 102.

The system 100 also includes a humidity sensing circuit (HSC) 118. The HSC 118 is configured to sense ambient humidity during respective, discrete sensing operations and to provide respective "Start" and "Stop" signaling 120 to the processor 102 in accordance with each humidity sensing operation. Each such humidity sensing operation is initiated (requested, or enabled) by a trigger voltage 122 provided by the processor 102. Further description regarding an illustrative example of the HSC 118 is provided hereinafter. The system 100 also includes a temperature sensing circuit (TSC) 124. The TSC 124 is configured to sense ambient temperature and to provide a present (instantaneous) temperature value by way of electronic signals 126 to the processor 102.

The system 100 also includes a time-base oscillator or "clock" 128. The clock 128 provides electronic pulses (clock pulses) 130 to the processor 102. In one example, the clock 128 is defined by or includes an oscillator or multi-vibrator based on a quartz crystal timing element. In one example, the clock 128 provides a stream 130 of precision-spaced electrical pulses at an operating frequency of 50 megahertz (MHz). Other time-base oscillator 128 types or operating frequencies can also be used.

The system 100 further includes a non-volatile memory (or storage) 132. The storage 132 stores lookup data 134 that can be accessed by (communicated to) the processor 102. The storage 132 can be variously defined and is coupled in bidirectional electronic data communication 136 with the processor 102. The processor 102 can thus read the lookup data 134, or store new data or change the contents of the lookup data 134, by way of the data communication 136.

General, normal operations of the ink-jetting printing system 100 are as follows: the processor 102 operates according to the program code 106 in order to control the print engine 108 and the transport mechanism 114 so as to print images on sheet media 112. Such printing is typically, but not necessarily, performed in accordance with an electronic file (e.g., a photograph, a business document, and so on) received from another entity (e.g., a user computer) by way of electronic communication.

The timing or triggering of a humidity measurement is performed according to the program code 106. A humidity measurement can be performed every so many minutes or hours, once per day, in response to a change in type of the media 112, in response to start-up of the system 100, or in accordance with other operating strategies. The processor 102 provides a trigger voltage 122 to the humidity sense circuit 118 when an ambient humidity measurement is needed or desired.

The trigger voltage 122 causes the HSC 118 to sense ambient relative humidity by way of a capacitive-type sensor. Specifically, a charge voltage across the sensor increases with time. Once the charge voltage crosses a first (lesser) threshold voltage, the HSC 118 asserts (or provides) "Start" signaling 120 to the processor 102. Some time thereafter, the charge voltage crosses a second (greater) threshold voltage, and the HSC asserts "Stop" signaling 120 to the processor 102.

The processor 102, in accordance with the program code 106, performs a counting function starting from zero, which begins with assertion of the "Start" signal and ends with assertion of the "Stop" signal. The counting is incremented according to the clock pulses 130. Thus, the greater the time interval between the respective assertions of the "Start" and "Stop" signals, the greater the overall count. The resulting integer count value 138 correlates directly to the ambient humidity being sensed by the HSC 118. The integer count value 138 is accumulated, for example, in a register or other suitable resource of the processor 102.

The processor 102 uses the integer count value (or count) 138 to select a printing speed for operating the print engine 108 and (optionally) the transport mechanism 114. Generally, the greater the relative humidity—based on the integer count value 138—the slower the selected printing speed, thus providing more time for the ink and media 112 to dry before being handled by a user, brought into contact with other media, and so on. Smudges, smears and/or other undesirable image defects are reduced or avoided in this way.

In one example, the processor 102 uses the integer count value 138 to cross-reference (access) particular lookup data 134, which includes one or more operating parameters related to a particular printing speed. In another example, the processor 102 uses the integer 138 value and a present temperature value to cross-reference corresponding lookup data 134. Two or more distinct printing speeds can be predefined, and corresponding lookup data 134 stored within the non-volatile memory 132.

Illustrative Humidity Sense Circuit

Figure 2:
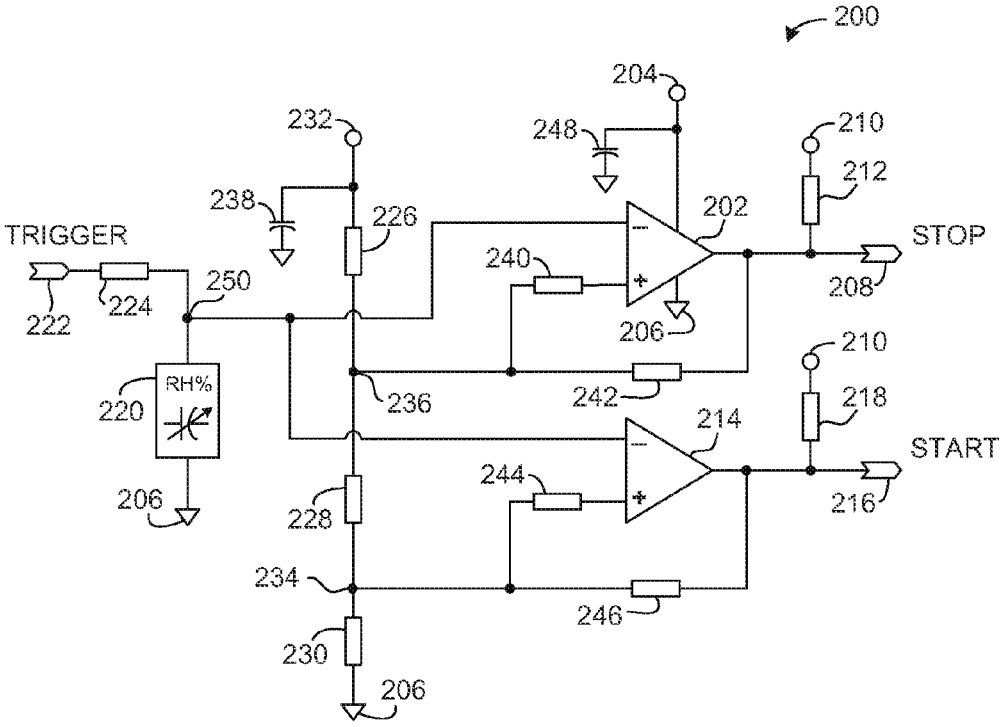
FIG. 2 depicts a schematic diagram of a humidity sensing circuit according to another examples of the present teachings.

Reference is made now to FIG. 2, which depicts a schematic diagram of an electronic circuit (circuit) 200 in accordance with the present teachings. The circuit 200 is illustrative and non-limiting with respect to the present teachings. Other electronic circuits, having respectively varying constituencies or configurations, can also be used. In one example, the humidity sensing circuit 118 is defined, in whole or in part, by the electronic circuit 200.

The circuit 200 includes a comparator 202. The comparator 202 is coupled to a source of electrical operating power by way of an input node 204 and a ground node 206. In one example, the node 204 is coupled to a source of 5.0 volts direct-current (VDC) relative to ground node 206. Other suitable voltages can also be used. The comparator 202 asserts an output signal to or toward ground potential ("low") at a node 208, in accordance with a comparison of respective voltages present at an inverting ("−") input and a non-inverting ("+") input. The output node 208 is otherwise biased toward 5.0 VDC ("high") present at a node 210 by way of a resistor 212. Other biasing voltages at the node 210 can also be used.

The circuit 200 also includes a comparator 214. As depicted, the comparator 214 is a portion of an integrated circuit having (or defining) the comparator 202 and, as such, the comparator 214 receives operating power by way of internal circuitry thereof. The comparator 214 asserts an output signal 'low' at a node 216, in accordance with a comparison of respective voltages present at an inverting ("−") input and a non-inverting ("+") input. The output node 216 is otherwise biased "high" by virtue of voltage present at the node 210 by way of a resistor 218. In one example, the comparators 202 and 214 are respective portions of an integrated circuit model LM393 Dual Differential Comparator, as available from Texas Instruments Inc., Dallas, Tex., USA. Other suitable comparators can also be used.

The circuit 200 also includes a capacitive-type humidity sensor (sensor) 220. In one example, the sensor 220 is defined by a model HS1101 LF, as available from Measurement Specialties, Inc., Hampton, Va., USA. Other suitable relative humidity sensors can also be used. The sensor 220 is characterized by an electrical capacitance that increases with relative humidity. The sensor 220 is coupled to receive a trigger voltage (signal, or biasing) at a node 222 by way of an electrical resistance 224. The sensor 220 is also coupled to ground node 206.

The circuit 200 also includes a resistor 226, a resistor 228 and a resistor 230. The respective resistors 226-230 are connected to each other in series-circuit arrangement, between the ground node 206 and a voltage input node 232. In one example, the node 232 is coupled to a source of 5.0 VDC during normal operations. Other suitable voltages can also be used. The series arrangement of the resistors 226-230 defines a voltage divider providing a first (lesser) threshold voltage at a node 234, and a second (greater) threshold voltage at a node 236. The circuit 200 also includes a filter or noise attenuation capacitor 238.

The non-inverting "+" input of the comparator 202 is coupled to the greater threshold voltage at the node 236 by way of a resistor 240, while the output of the comparator 202 is coupled to provide positive feedback by way of a resistor 242. The comparator 202 thus exhibits some amount of hysteresis during normal operation by virtue of the positive feedback through resistor 242.

In turn, the non-inverting "+" input of the comparator 214 is coupled to the lesser threshold voltage at the node 234 by way of a resistor 244, while the output of the comparator 214 is coupled to provide positive feedback by way of a resistor 246. The comparator 214 therefore exhibits some hysteresis during normal operation. The circuit 200 also includes a filter or noise attenuation capacitor 248.

The respective inverting "−" inputs of the comparators 202 and 214 are coupled to monitor a charge voltage across the sensor 220 at a node 250, as is present during normal humidity sensing operations. Typical, normal operation of the circuit 200 is described hereinafter with reference to FIG. 3.

Illustrative Signal Timing Diagrams

Figures 3, 4:
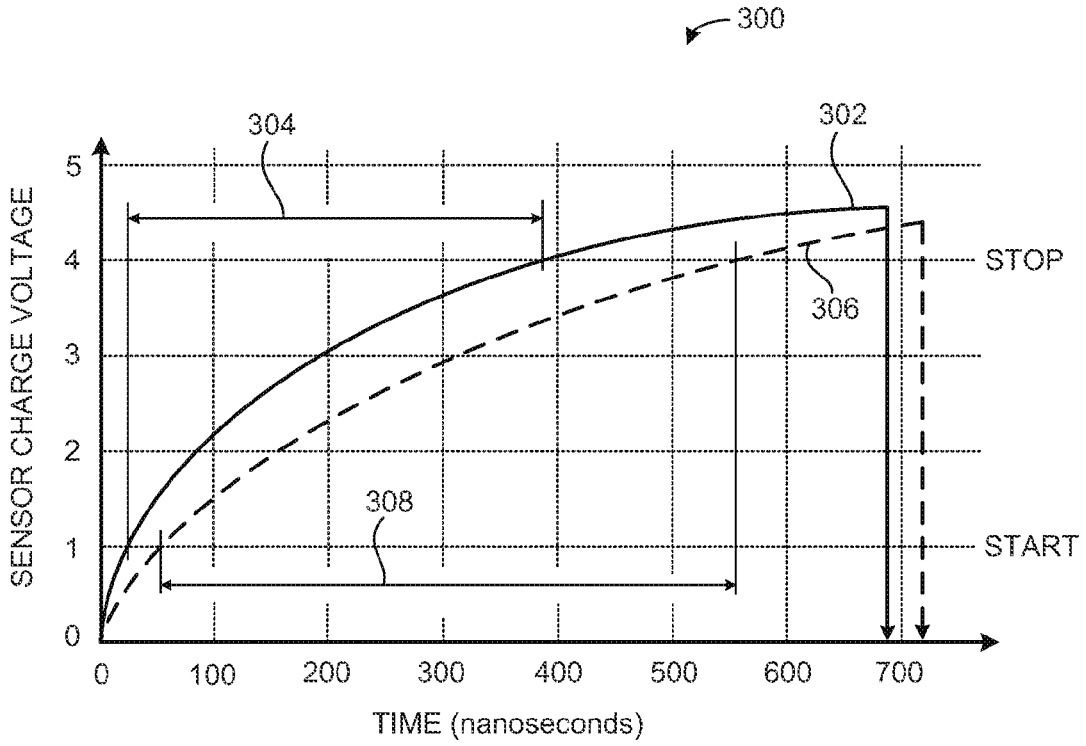
FIG. 3 depicts a signal timing diagram according to an illustrative example of the present teachings.
FIG. 4 depicts a table of correlated parameters according to another example.

Reference is made now to FIG. 3, which depicts a signal timing diagram (diagram) 300 in accordance with an illustrative and non-limiting example of the present teachings. The diagram 300 is described with reference to the circuit 200.

The diagram 300 includes a first signal curve 302 corresponding to a charge voltage across the sensor 220 during one illustrative humidity sensing (measuring) operation. The signal curve 302 begins at time zero, when a trigger voltage (e.g., 5.0 VDC) is provided at the node 222 and maintained during the course of one humidity measuring operation. The signal curve 302 increases non-linearly with time in accordance with a first-order resistive-capacitive (RC) charging or transfer function.

When the signal curve (charge voltage) 302 crosses a first threshold of 1.0 VDC, the comparator 214 asserts the "Start" signal "low" at the node 216, which is provided to a processor (e.g., 102) or another entity that begins counting from zero. The counting operation is incremented with each clock signal pulse (e.g., 130) provided to the counter. Thereafter, when the signal curve 302 crosses a second threshold of 4.0 VDC, the comparator 202 asserts the "Stop" signal "low" at the node 208, which is provided to the processor or other counting entity. The processor (or counter) then halts the count in response to the asserted "Stop" signal, thus defining an integer count value 138 for the present humidity measuring operation.

The trigger voltage at the node 222 is sometime thereafter removed, or biased to ground node 206, thus discharging the capacitive sensor 220 and preparing it for a subsequent humidity measurement at some future time. A time interval 304 is defined between the assertion of the "Start" signal and the assertion of the "Stop" signal, during which the counting operation is performed.

The diagram 300 also includes a second signal curve 306 corresponding to a charge voltage across the sensor 220 during another illustrative humidity measuring operation. The signal curve 306 begins at time zero, when a trigger voltage is provided at the node 222 and maintained during the present humidity measuring operation. The signal curve 306 increases non-linearly with time in accordance with an RC charging function.

When the signal curve 306 crosses the first threshold level, the comparator 214 asserts the "Start" signal "low" at the node 216. A counting operation then begins from zero, incrementing with each clock signal pulse. Thereafter, the signal curve 306 crosses the second threshold level, and the comparator 202 asserts the "Stop" signal "low" at the node 208. The processor (or counter) halts the present count in response to the asserted "Stop" signal, and an integer count value 138 for the present humidity measuring operation is thus defined.

The trigger voltage at the node 222 is thereafter removed or biased to ground node 206, discharging and preparing the capacitive sensor 220 for a later humidity measurement. A time interval 308 is defined between the assertion of the "Start" signal and the assertion of the "Stop" signal, during which the counting operation is performed. Additionally, the signal curve 302 corresponds to a relatively lesser electrical capacitance, and thus a lesser relative humidity, than those of the signal curve 306. Accordingly, the signal curve 302 is associated with a lesser time interval 304 and a lesser integer count value 138, than those of the signal curve 306.

The signal timing diagram 300 depicts particular illustrative voltage and time scales, respectively, in the interest of clarity. The present teachings contemplate various humidity sensing circuits and their respective operations characterized by other voltage scales, time scales or other parameters.

Illustrative Drying Times Table

Attention is turned now to FIG. 4, which depicts a table of correlated drying times, relative humidity values and integer count values. The table 400 is illustrative and non-limiting, and other correlative values and parameters can also be used in accordance with the present teachings.

The table 400 includes a first row 402, corresponding to humidity conditions generally requiring a relatively longer media/ink drying time. The relative humidity requiring longer drying time, and thus a slower average printing speed, is in the range of 73.0% to 80.0%. In turn, integer count values greater than 519 can be used to select a relatively slower printing speed.

The table 400 also includes a second row 404, corresponding to humidity conditions generally requiring a moderate media/ink drying time and thus a moderate average printing speed. The corresponding relative humidity is in the range of 62.0% to 72.0%, correlated to an integer count value in the range of 512 to 519, accordingly.

The table 400 further includes a third row 406, corresponding to humidity conditions generally permissive of a short media/ink drying time and thus a fast (or full) average printing speed. The corresponding relative humidity is in the range of 20.0% to 61.0%, correlated to integer count values lesser than 512.

Illustrative Table of Constituents

Reference is directed to FIG. 5, which depicts a table 500. The table 500 cites specific models, electrical characteristics and/or sources for elements of the circuit 200. Other embodiments of humidity sensing circuit having other respectively varying constituencies can also be used.

Illustrative Method

Figure 6:
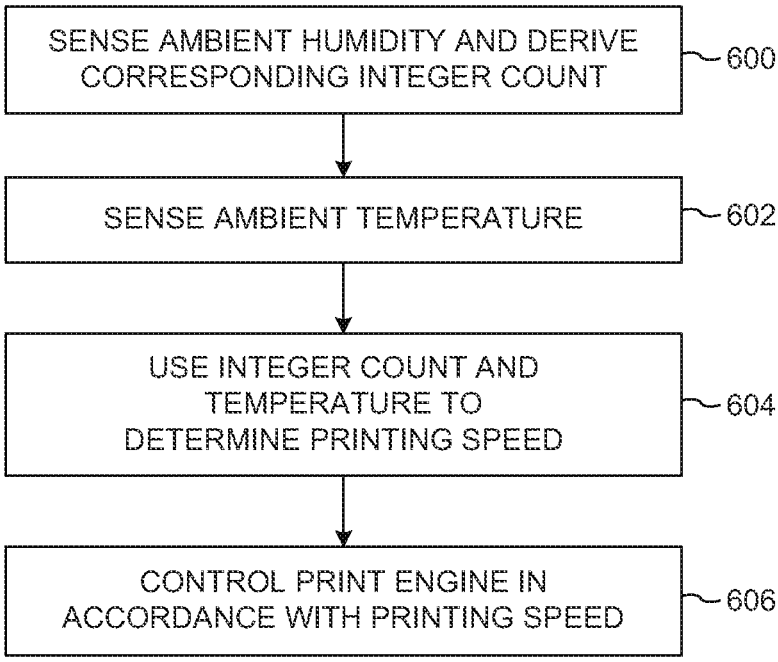
FIG. 6 depicts a flow diagram of method steps according to another example of the present teachings.

Reference is made now to FIG. 6, which depicts a flow diagram of a method according to the present teachings. The method of FIG. 6 includes particular steps performed in a particular order of execution. However, other methods including other steps, omitting one or more of the depicted steps, or proceeding in other orders of execution can also be defined and used. Thus, the method of FIG. 6 is illustrative and non-limiting with respect to the present teachings. Reference is also made to FIG. 1 in the interest of illustrating the method of FIG. 6.

At 600, ambient humidity is sensed and a corresponding integer count is derived. For purposes of a present example, the processor 102 provides a trigger voltage 122 to the HSC 118, In turn, the HSC 118 asserts first a "Start" signal and sometime thereafter a "Stop" signal, by way of electronic signaling 120 to the processor 102. The processor 102 operates as a counter and derives an integer count value 138 during the time interval between the "Start" and "Stop" signals. The integer count value 138 corresponds to the ambient relative humidity at the HSC 118. For purposes of non-limiting illustration, it is assumed that an integer count value of 514 was derived in response to an ambient relative humidity of 68%.

At 602, ambient temperature is sensed. For purposes of the present example, the TSC 124 communicates an instantaneous ambient temperature value to the processor 102 by way of electronic signals 126. For purposes of non-limiting illustration, it is assumed that an ambient temperature of 71 Degrees Fahrenheit is sensed and communicated.

At 604, the integer count and temperature are used to determine a printing speed. In accordance with the present example, the integer count value 138 and temperature are used to cross-reference a printing speed, characterized by one or more operating parameters, within the lookup data 134. The processor 102 thus accesses the lookup data 134 and determines that a MODERATE printing speed should be used, in view of the present ambient humidity and temperature.

At 606, a print engine is controlled in accordance with the selected printing speed. For purposes of the present example, a MODERATE printing speed corresponds to ink-jet imaging, while transporting the sheet media 112 at 8 inches per second. In addition to adjustments in paper feed speed, adjustments can be made to other inkjet printing attributes as necessary to distinguish between long, moderate, or short drying profiles. These can include, but are not limited to, the following: ink coverage in dense fill areas, wait time before the sheet is deposited into the output tray, adjustments to output tray features that constrain the sheet and ensure output tray tidiness, color-map and half-toning settings, and so on.

In general, the present teachings contemplate systems, electronic circuits and methods for controlling print speed within an ink-jetting printer in accordance with ambient humidity. An electronic circuit includes a humidity sensor characterized by electrical capacitance that varies in accordance with relative humidity. The electronic circuit monitors charge voltage across the sensor during each discrete relative humidity measurement. The electronic circuit asserts a first or "Start" signal when the charge voltage crosses a first (lesser) threshold, and thereafter asserts a second or "Stop" signal when the charge voltage crosses a second (greater) threshold.

A processor or other counting device counts from zero during the time interval between the assertion of the "Start" signal and the assertion of the "Stop" signal. The counting operation results in an integer count value. Typically, depending on sensor model, a greater count value corresponds to a greater ambient relative humidity. Temperature can also be sensed and a corresponding signal provided to the processor (or other circuitry).

The integer count value, and optionally a temperature value, can be used to cross-reference a printing speed or related parameters within a lookup data table. Alternatively, a printing speed or related parameters can be calculated formulaically. An ink-jetting print engine and/or other aspects of a printer can be controlled in accordance with the determined printing speed or related parameters so that sufficient media drying time is provided. Smudges, smearing or other undesirable imaging defects are thus minimized or avoided.

In general, the foregoing description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

What is claimed is:

1. An electronic circuit, comprising:

a sensor having an electrical capacitance that changes in response to changes in ambient humidity, the sensor to provide a charge voltage signal;

a first comparator to assert a start signal based on a comparison of the charge voltage signal with a first threshold voltage;

a second comparator to assert a stop signal based on a comparison of the charge voltage signal with a second threshold voltage; and a processor to start incrementing a count value in response to the assertion of the start signal by the first comparator, to stop incrementing the count value in response to the assertion of the stop signal by the second comparator, and to determine the ambient humidity based on the count value after stopping the counting, the processor to increment the count value in response to a clock.

2. The electronic circuit according to claim 1, further comprising a plurality of resistors arranged as a voltage divider, a first node of the voltage divider to provide the first threshold voltage to the first comparator and a second node of the voltage divider to provide the second threshold voltage to the second comparator.

3. The electronic circuit according to claim 1, further comprising one or more resistors to couple the sensor to a trigger node, the sensor to increase the charge voltage signal while a trigger voltage is present at the trigger node.

4. The electronic circuit according to claim 3, wherein the processor is to apply the trigger voltage to the trigger node during sensing of ambient humidity, the sensor to increase the charge voltage signal while the trigger voltage is applied.

5. The electronic circuit according to claim 1, wherein the first comparator is to assert the start signal when the charge voltage signal is greater than the first threshold voltage, and the second comparator is to assert the stop signal when the charge voltage signal is greater than the second threshold voltage.

6. The electronic circuit according to claim 1, wherein the processor is to determine a printing speed for a print engine using the count value.

7. A printing system, comprising:

a print engine to form images on media;

a processor to control the print engine;

a sensing circuit comprising a sensor having an electrical capacitance that changes in response to changes in ambient humidity, the sensing circuit to provide a start signal and a stop signal to the processor, a time between the start signal and the stop signal being based on the electrical capacitance of the sensor;

storage media including machine-readable instructions, the instructions to cause the processor to at least:

in response to assertion of the start signal by the sensing circuit, increment a count value based on a clock signal; and in response to assertion of the stop signal by the sensing circuit, determine at least one parameter associated with controlling the print engine based on the count value.

8. The printing system according to claim 7, wherein the sensing circuit comprises:

a first comparator to assert the start signal based on a comparison of a charge voltage on the sensor with a first threshold voltage; and a second comparator to assert the stop signal based on a comparison of the charge voltage with a second threshold voltage.

9. The printing system according to claim 7, wherein the instructions are to cause the processor to select between at least two distinct printing speeds based on the at least one parameter.

10. The printing system according to claim 7, further comprising a storage medium to store lookup data, the instructions to cause the processor to determine the at least one parameter using the count value and the lookup data.

11. The printing system according to claim 10, further comprising a temperature sensor to provide a temperature signal, the instructions to cause the processor to determine the at least one parameter based on the temperature signal, the count value, and the lookup data.

12. The printing system according to claim 7, wherein the instructions are to cause the processor to provide a trigger signal to increase a charge signal voltage at the sensor.

13. A printing system, comprising:

a print engine to form images on media by way of ink-jetting;

a processor to control operation of the print engine;

a sensing circuit including a sensor characterized by an electrical capacitance varying according to ambient humidity, the sensing circuit to provide a start signal and a stop signal to the processor;

a storage media including machine-readable program code, the program code to cause the processor to derive an integer count value in accordance with the start signal and the stop signal, the program code to cause the processor to determine at least one parameter for controlling the print engine using the integer count value; and an oscillator to provide a clock signal, the program code to cause the processor to perform a counting function incremented in accordance with the clock signal, the integer count value derived in accordance with the counting.

* * * * *